US006154915A

United States Patent [19]

Wiseman, Jr.

[11] Patent Number: 6,154,915

[45] Date of Patent: Dec. 5, 2000

[54] SWIMMING POOL AID

[76] Inventor: Orville A. Wiseman, Jr., 7585 E. Sweetwater, Scottsdale, Ariz. 85250

[21] Appl. No.: 09/158,353

[22] Filed: Sep. 21, 1998

[51] Int. Cl.[7] ..... E04B 4/16

[52] U.S. Cl. ..... 15/246; 15/1.7

[58] Field of Search ..... 15/1.7, 246; 138/106, 138/110

[56] References Cited

U.S. PATENT DOCUMENTS

| | | |
|---|---|---|
| D. 364,334 | 11/1995 | Sanstrom et al. . |
| 1,044,013 | 11/1912 | Burnett . |
| 2,650,113 | 8/1953 | Brace . |
| 3,108,298 | 10/1963 | Gelinas . |
| 3,217,886 | 11/1965 | Ruston . |
| 4,131,136 | 12/1978 | Sawyer . |
| 4,171,674 | 10/1979 | Hale . |
| 4,281,995 | 8/1981 | Pansini . |
| 4,534,306 | 8/1985 | Rutten et al. . |
| 4,632,051 | 12/1986 | Raymond et al. . |
| 5,143,605 | 9/1992 | Masciarelli . |
| 5,195,563 | 3/1993 | Brooks . |
| 5,226,205 | 7/1993 | Pearce . |
| 5,259,426 | 11/1993 | Burleigh . |
| 5,463,971 | 11/1995 | Abernethy . |
| 5,546,982 | 8/1996 | Clark et al. . |
| 5,557,819 | 9/1996 | Krolikowski . |

OTHER PUBLICATIONS

Kreepy Krauly Gram dated Dec. 4, 1991.

*Primary Examiner*—Deborah Jones
*Assistant Examiner*—Jennifer McNeil
*Attorney, Agent, or Firm*—Elizabeth A. Dawn; Charles E. Cates

[57] ABSTRACT

A device for reducing the likelihood that an automatic swimming pool cleaner will become stuck on the steps and corners of a swimming pool. The device has a continuous wall extending between a smaller end fitted to the circumference of the hose leading to or from the pool cleaner and a larger end facing the pool cleaner.

6 Claims, 2 Drawing Sheets

FIG. 2
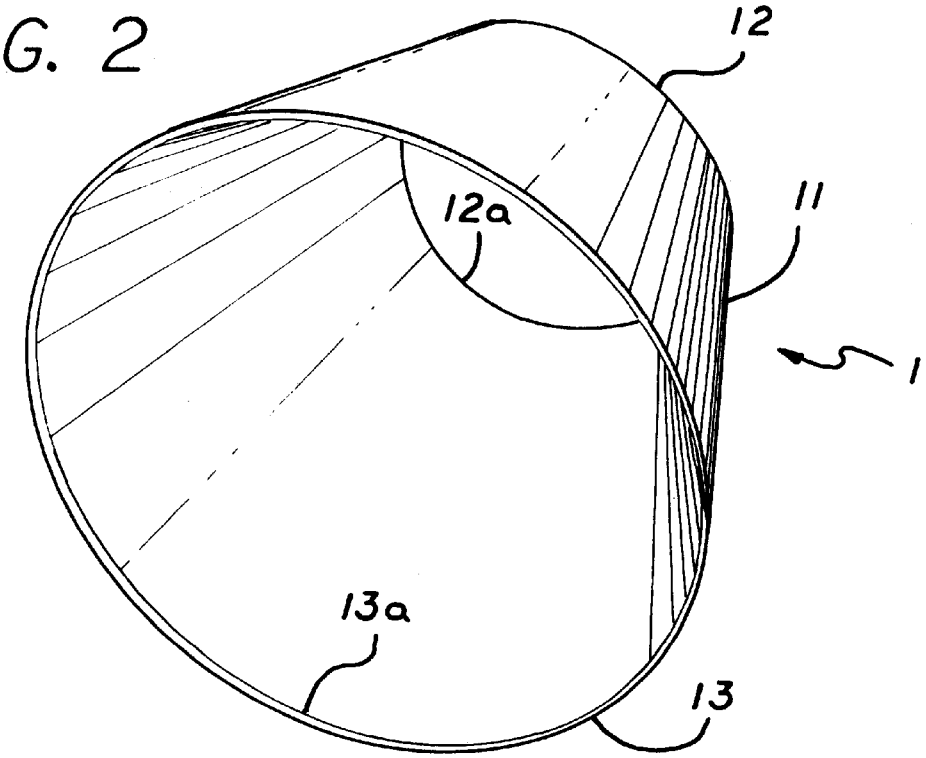
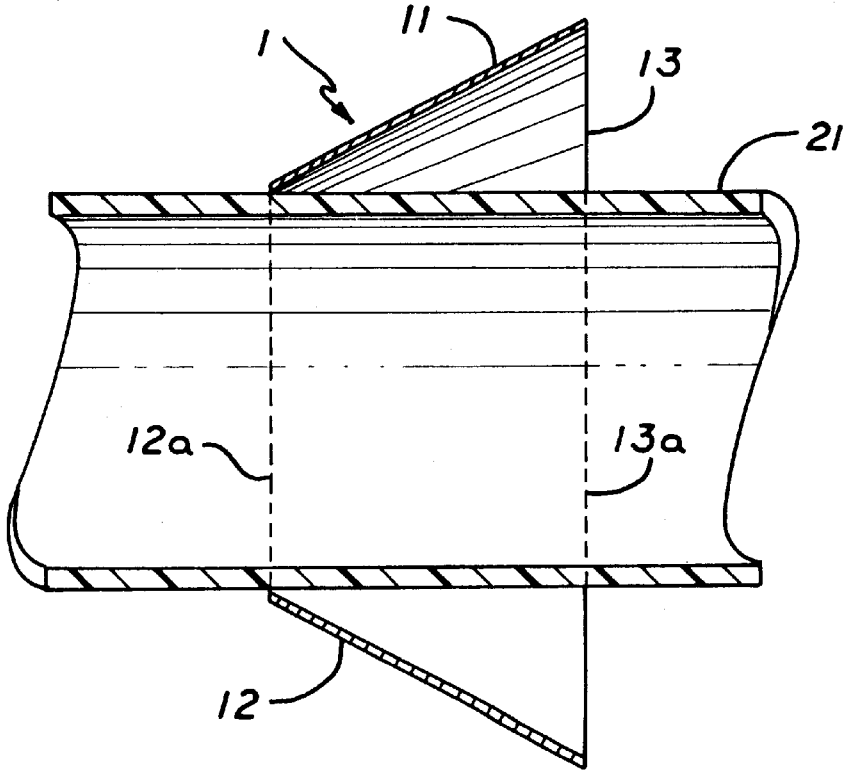
FIG. 3

SWIMMING POOL AID

The present invention relates to a device for reducing the likelihood that an automatic swimming pool cleaner will become stuck on the steps and corners of a swimming pool.

BACKGROUND OF THE INVENTION

It is not uncommon for some automatic swimming pool cleaners to become stuck on the steps and corners of a swimming pool. Over time, attempts have been made to develop solutions to this problem. One such attempt is to use a plastic wheel mounted to the hose extending between the swimming pool skimmer and the automatic swimming pool cleaner immediately adjacent to the head of the pool cleaner. The wheel acts as a bumper and has enjoyed some success in keeping the pool cleaner from becoming lodged on the steps and in the corners of the pool. Other attempts include bumpers which are attached directly to the pool cleaning head. Although both types of bumpers help in preventing the pool cleaner head from becoming stuck, neither type has proved entirely successful.

Generally speaking, there are two main types of automatic pool cleaners: a so called "suction side" cleaner, and a "pressure side" cleaner. In a suction side cleaner, a vacuum hose runs from the cleaner to the pool's filtration system, usually through the pool skimmer which is connected to the vacuum or return side of the filtration system. In this type of cleaner, the cleaner's movement is controlled by an internal on/off valve. As the cleaner moves about the floor and walls of the pool, it vacuums dirt, leaves, and the like and sends the debris through the hose to the filtration system. Examples of commercially available suction side cleaners are sold under the brand names "Kreepy Krauly" and "Baracuda".

In a pressure side cleaning system, water under pressure is supplied by a pump through a hose to the cleaner head and it is this pressurized water which operates the cleaner.

SUMMARY OF THE INVENTION

The present invention relates to a device which is attached to the hose extending to an automatic pool cleaner of the "suction side" type to reduce the likelihood of such an automatic pool cleaner becoming stuck or "hung up" on the steps and the comers of a swimming pool. The device has a continuous wall extending between a smaller end fitted to the circumference of the hose leading to or from the pool cleaner and a larger end facing the pool cleaner. The preferred embodiment of the device is a hollow frusto-conical shape tapering toward one end. In use, the device is positioned on the hose such that the end of the device having the larger diameter/circumference is facing toward the pool cleaner. The opening at the smaller end of the device should be sized so that the device fits snugly about the vacuum hose and does not move once positioned on the hose. It is believed that by changing the angle and direction of the hose, the path of the pool cleaner is altered such that, though continuous alterations of its path, the pool cleaner is able to work itself out of a corner or off the steps of the swimming pool.

It is an object of this invention to provide a means for preventing automatic swimming pool cleaners from becoming stuck on the steps or in the corners of the pool.

It is a further object of this invention to provide a small, convenient device that is inexpensive and easy to handle and install.

Other objects of the invention will become apparent hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 2 is perspective view of the device.

FIG. 3 is a sectional view of the device of the present invention mounted on a vacuum hose of a suction side pool cleaner.

DESCRIPTION OF THE PREFERRED EMBODIMENT

Figure 1:
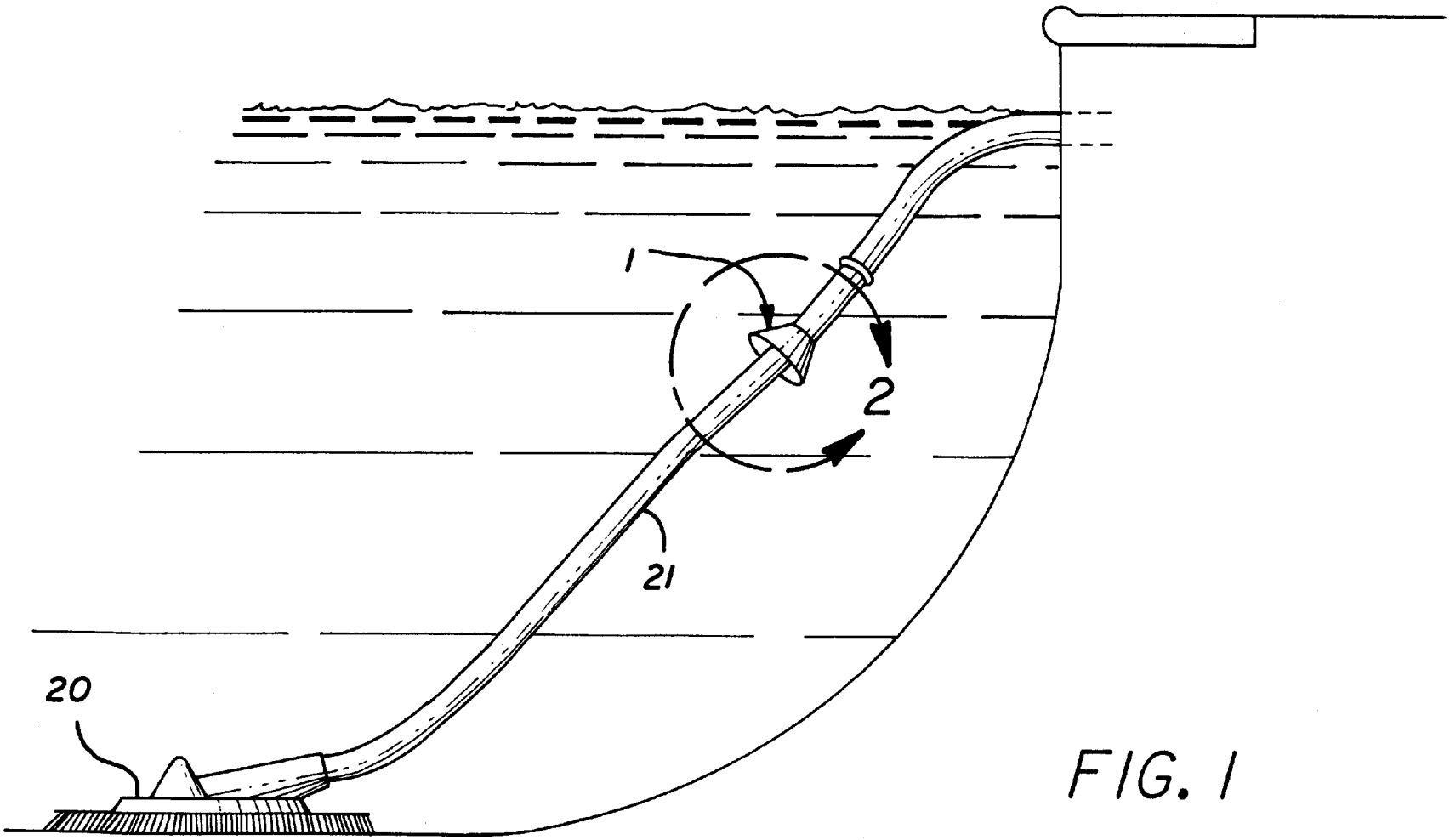
FIG. 1 shows the device of the present invention attached to the hose of an automatic pool cleaner in a swimming pool environment.

As shown best in FIG. 2, the preferred embodiment of the device of the present invention is shown generally at 1 and is funnel-like in appearance; more particularly, the preferred embodiment of the device is of a hollow frusto-conical shape having a continuous tapered wall 11 extending between circular shaped open ends 12 and 13. Each of open ends 12 and 13 is provided with a rim, 12*a* for end 12 and 13*a* for end 13. Rim 12*a* is designated the top rim, and rim 13*a* is designated the bottom rim. As shown, the interior of the device is hollow and the top rim 12*a* is of a smaller diameter than the bottom rim 13*a*, and thus top rim 12*a* forms a smaller diameter opening than does bottom rim 13*a*.

FIG. 1 shows a typical installation of an automatic pool cleaner of the suction side type in a swimming pool with the device 1 of the present invention installed therein. As shown, vacuum hose 21 connects the pool cleaner head 20 to a vacuum source (not shown), usually the skimmer of a swimming pool. Device 1 is positioned on hose 21 so that the open end 13, the larger diameter opening, is closest to the pool cleaner head 20 and that hose 21 fits through the second open end 12. As noted previously, open end 12 is of such diameter that it fits snugly about hose 21, and the device is not easily moved once it is positioned on the vacuum hose. In a specific embodiment of device 1, the diameter of smaller open end 12 is about 1 and ⅞ inches, the diameter of larger open end 13 is about 4 inches, and the length of the device is about 2.5 inches. The device should be made of a material that will insure rigidity, preferably a rigid plastic or a non-corroding metal such as aluminum or stainless steel.

In operation, I have discovered that in mounting the device to the vacuum hose, it is important that the larger diameter open end 13 be closest to the pool cleaner 20 as shown in FIG. 1. Also, the device is particularly effective with the suction side type pool cleaners. Further, it is preferred that the device be mounted on the vacuum hose about 6 to 12 feet from the cleaner head 20.

I claim:

1. A device for reducing the likelihood that an automatic pool cleaner of the suction side type will become lodged on the steps and corners of a swimming pool, said pool cleaner being attached to a hose leading to a vacuum source, said device being positioned on said hose at a distance from said pool cleaner, and said device having a continuously tapered wall extending between a first open end of a larger diameter and a second open end of such a diameter that it fits snugly about said hose.

2.The device of claim 1 wherein said device having a continuous wall extending between a first open end of a larger diameter than a second open end has a frusto-conical shape.

3. The device of claim 2 wherein said first open end of larger diameter is positioned to be closer to said automatic pool cleaner than said second open end.

4. A method for reducing the likelihood that an automatic pool cleaner of the suction side type will become lodged on the steps and corners of a swimming pool said cleaner having a hose connected to a vacuum source, said method comprising the steps of mounting to said hose a device having a continuously tapered wall extending between a first open end of a larger diameter than a second open end, said method further comprising positioning said device on said hose between said cleaner and said vacuum source at a distance from said cleaner in such a manner that said first open end of said device is closest to said pool cleaner.

5. The method of claim 4 wherein said device having a continuous wall extending between a first open end of a larger diameter than a second open end has a frusto-conical shape.

6. The method of claim 5 wherein said second open end of said device fits snugly about said hose.

* * * * *

UNITED STATES PATENT AND TRADEMARK OFFICE

CERTIFICATE OF CORRECTION

PATENT NO. : 6,154,915
DATED : December 5, 2000
INVENTOR(S) : Orville A. Wiseman, Jr.

It is certified that error appears in the above-identified patent and that said Letters Patent is hereby corrected as shown below:

Claim 1, column 2
Line 60, the words "continuously tapered" should be deleted and the words -- continuous wall -- should be inserted.

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*